United States Patent [19]

Koller et al.

[11] 4,107,562

[45] Aug. 15, 1978

[54] X-RAY BEAM GENERATOR

[75] Inventors: Thomas J. Koller, Huntington; Jacob A. Randmer, Wilton, both of Conn.

[73] Assignee: The Machlett Laboratories, Inc., Stamford, Conn.

[21] Appl. No.: 719,026

[22] Filed: Aug. 30, 1976

[51] Int. Cl.[2] ..... H01J 35/18

[52] U.S. Cl. ..... 313/59; 313/60

[58] Field of Search ..... 313/59; 250/510, 505

[56] References Cited

U.S. PATENT DOCUMENTS

| | | | |
|---|---|---|---|
| 2,407,857 | 9/1946 | Verhoeff | 313/59 X |
| 3,134,903 | 5/1964 | Fengler | 313/59 X |

*Primary Examiner*—Rudolph V. Rolinec
*Assistant Examiner*—Darwin R. Hostetter
*Attorney, Agent, or Firm*—J. T. Meaney; J. D. Pannone; H. A. Murphy

[57] ABSTRACT

An X-ray generator comprising a shielded housing having insulatingly mounted therein an X-ray tube provided with a predetermined focal spot area on a sloped target surface which is radially aligned with an X-ray transmissive window in the housing, the window having a preferred configuration for reducing preferential absorption of X-rays in a divergent beam emanating from the focal spot area of the target.

6 Claims, 15 Drawing Figures

FIG. 1
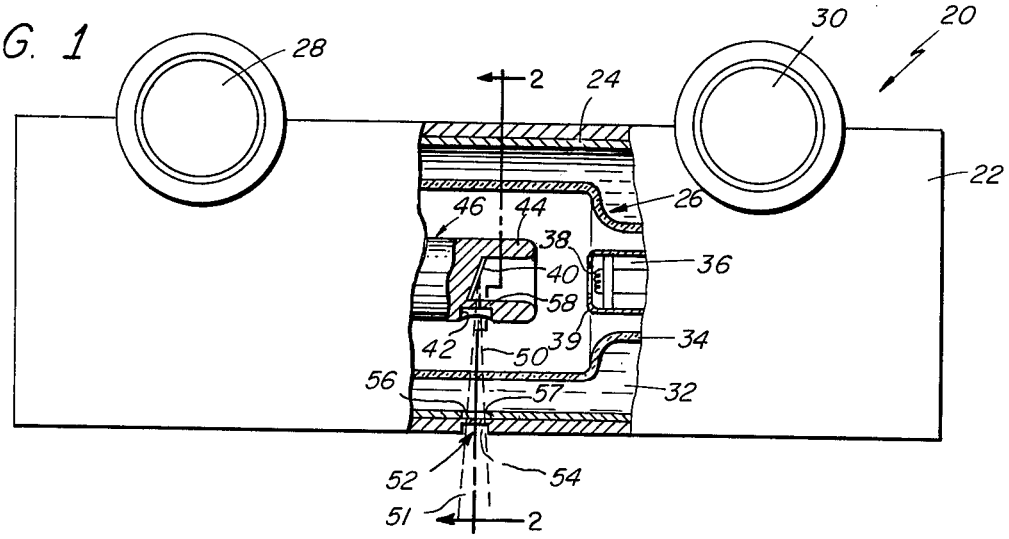
FIG. 3
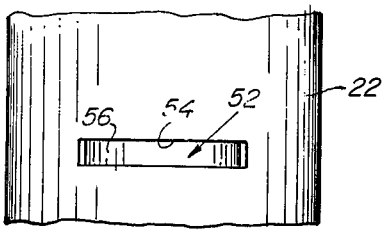
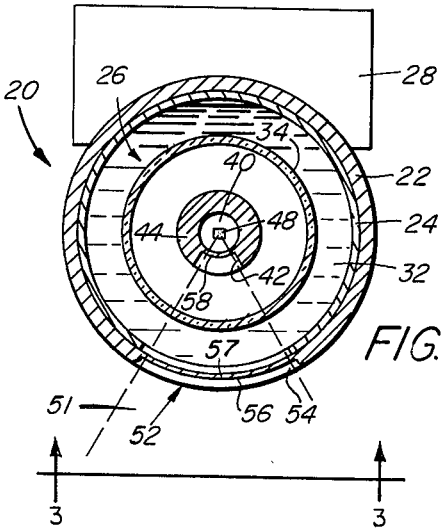
FIG. 2
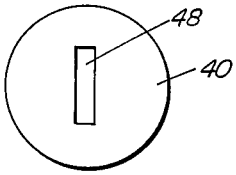
FIG. 4A
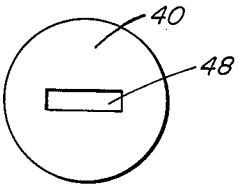
FIG. 4B
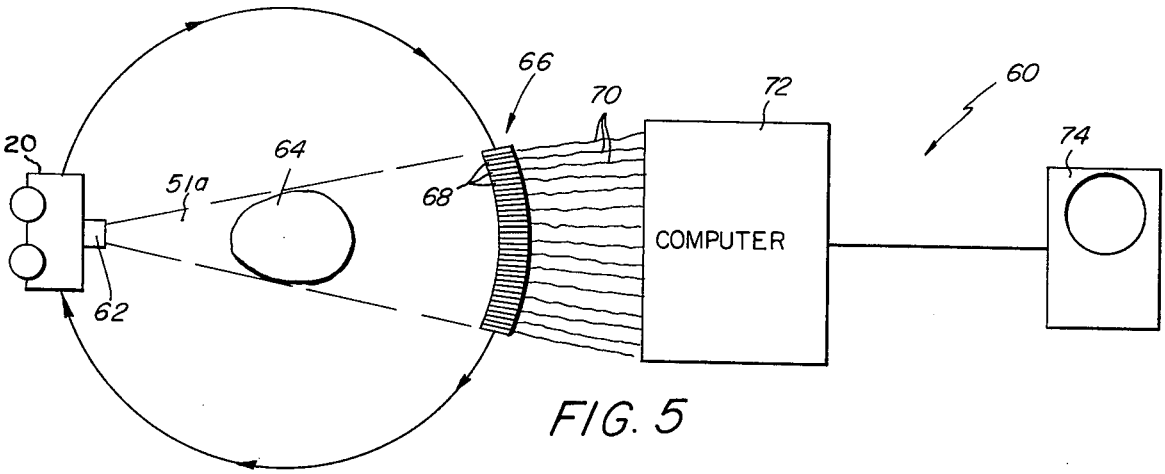
FIG. 5

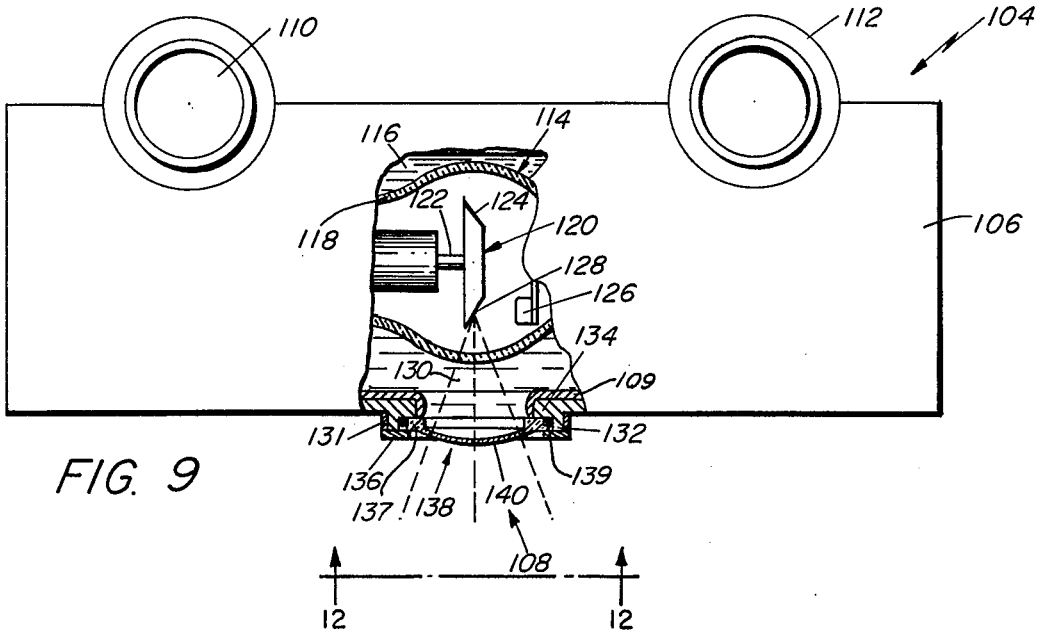
FIG. 9
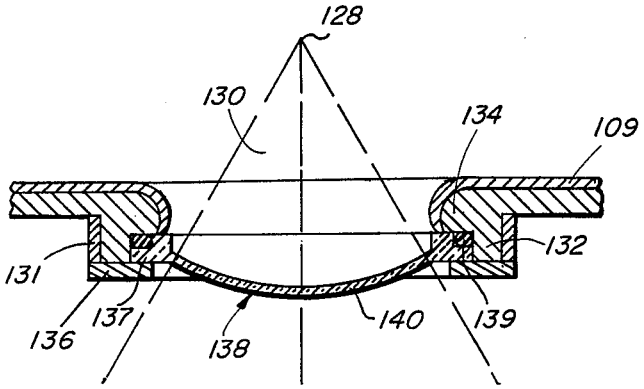
FIG. 10
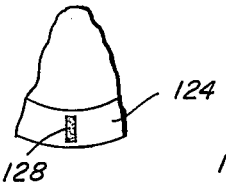
FIG. 11A
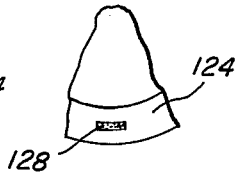
FIG. 11B
FIG. 12
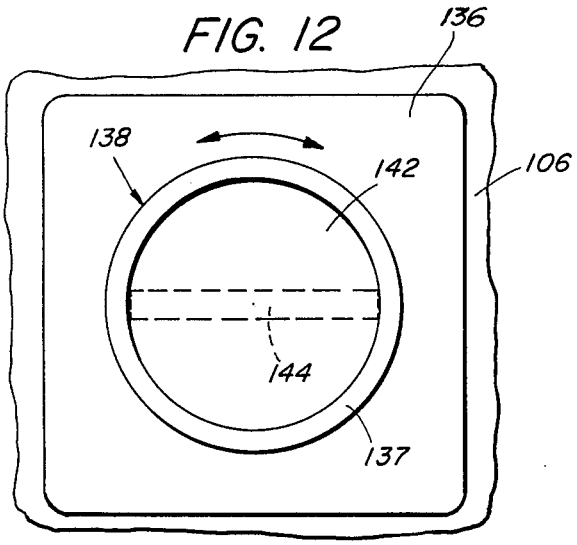
FIG. 13
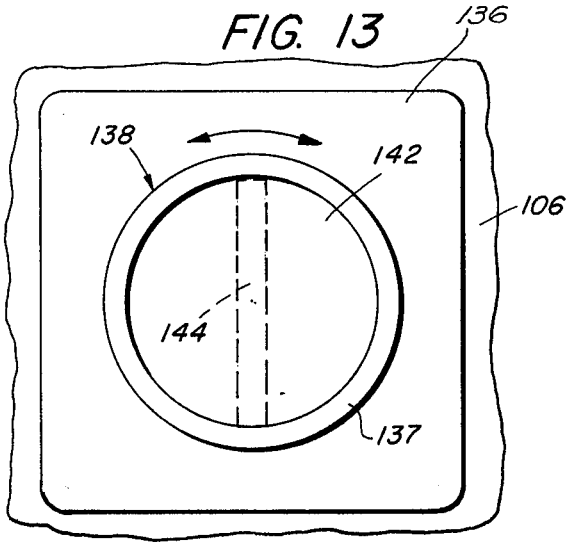

X-RAY BEAM GENERATOR

BACKGROUND OF THE INVENTION

1. Field of the Invention

This invention relates generally to X-ray generators and is concerned more particularly with an X-ray generator having symmetrical beam egressing means.

2. Discussion of the Prior Art

An X-ray generator generally comprises a shielded housing having insulatingly mounted therein an X-ray tube, which may be cooled by a dielectric fluid flowing through the housing. The X-ray tube usually includes an evacuated envelope wherein an electron emitting cathode is disposed for beaming high energy electrons onto a sloped target surface of an axially spaced anode. Thus, X-rays are generated which emanate from the sloped target surface and radiate in a divergent beam through a radially aligned port in the housing.

Generally, the port is recessed and includes an X-ray transmissive window which is reentrant toward the focal spot area of the tube to reduce beam filtration. Because of its proximity to the highly positive anode of the tube, the window usually is made of an easily moldable dielectric material, which is provided with a flat surface adjacent the wall of the tube. As a result, it is found that a divergent X-ray beam passing through the window has a non-uniform distribution of X-ray intensity as a function of beam angle. The greater the divergent angle of the beam, the greater the absorption of X-rays adjacent the edges of the beam. This preferential angular absorption of X-rays in the divergent beam is particularly troublesome in certain diagnostic procedures where it is advantageous to have an incident X-ray beam cross-section which is substantially uniform. In computerized tomography, for example, it is desirable to detect, in an irradiated patient, an X-ray absorption difference of about one-half of one percent.

Therefore, it is advantageous and desirable to provide an X-ray generator with means for minimizing preferential angular absorption of X-rays in a divergent beam egressing from the generator.

SUMMARY OF THE INVENTION

Accordingly, this invention provides an X-ray generator comprising a shielded housing having X-ray transmissive means symmetrically disposed in radially aligned relationship with a focal spot area on a sloped target surface of an X-ray tube insulatingly mounted in the housing.

The housing may comprise a hollow metal cylinder having closed ends and having the X-ray tube longitudinally disposed therein. The X-ray tube may be of the stationary anode type having an evacuated tubular envelope wherein an axially extending anode cylinder has a sloped target surface disposed in axially spaced relationship with an electron emitting cathode. Electrons from the cathode may be focused electrostatically onto an elongated focal spot area, which may extend longitudinally or transversely with respect to the slope of the target surface. Accordingly, the X-ray transmissive means may include a port comprising a portion of the housing wall disposed in radially aligned, symmetrical relationship with the focal spot area on the sloped target surface. The port may comprise a narrow groove cut in the housing wall to a suitable depth for providing a remaining wall of predetermined thickness which permits X-rays of a desired intensity to egress in a fan-shaped beam. The resulting fan-shaped beam is useful in computerized tomography, where it is passed through a selected portion of a patient and impinges on an arcuate array of detectors.

Alternatively, the X-ray tube may be of the rotating anode type having an evacuated tubular envelope wherein an electron emitting cathode is disposed in spaced alignment with a focal spot area on an annular sloped target track adjacent the periphery of a rotatable anode disc. The focal spot area may be elongated and extend along the slope of the target surface or may extend transversely thereof. Accordingly, the X-ray transmissive means may include a plate which is suitably secured over an opening in a portion of the cylindrical housing wall aligned with the focal spot area. The plate is provided with a cavity having at the bottom thereof an X-ray transmissive wall thickness which is symmetrically disposed with respect to the focal spot area adjacent the periphery of the rotatable target disc. Thus, the cavity may have an arcuately grooved or a spherically curved configuration; and the plate may be rotated about the center of the opening in the housing wall.

BRIEF DESCRIPTION OF THE DRAWINGS

For better understanding of this invention, reference is made in the following more detailed description to the drawings wherein:

FIG. 1 is a plan view, partly in axial section, of an X-ray generator embodying the invention;

FIG. 2 is a transverse cross-sectional view taken along the line 2—2 shown in FIG. 1 and looking in the direction of the arrows;

FIG. 3 is a fragmentary elevational view taken along the line 3—3 shown in FIG. 2 and looking in the direction of the arrows;

FIGS. 4*a*–4*b* illustrate alternative focal spot areas of the stationary target surface shown in FIG. 1;

FIG. 5 is a schematic view of a computerized tomography system embodying the X-ray generator shown in FIG. 1;

FIG. 9 is a plan view, partly in section, of an alternative X-ray generator embodying the invention;

FIG. 10 is an enlarged fragmentary sectional view of the housing port shown in FIG. 9;

FIGS. 11*a*–11*b* illustrate alternative focal spot areas of the rotating target surface shown in FIG. 9;

FIG. 12 is a fragmentary elevational view taken along the line 12—12 shown in FIG. 9 and looking in the direction of the arrows; and FIG. 13 shows the window in FIG. 12 rotated 90°.

DESCRIPTION OF THE PREFERRED EMBODIMENTS

Figure 6:
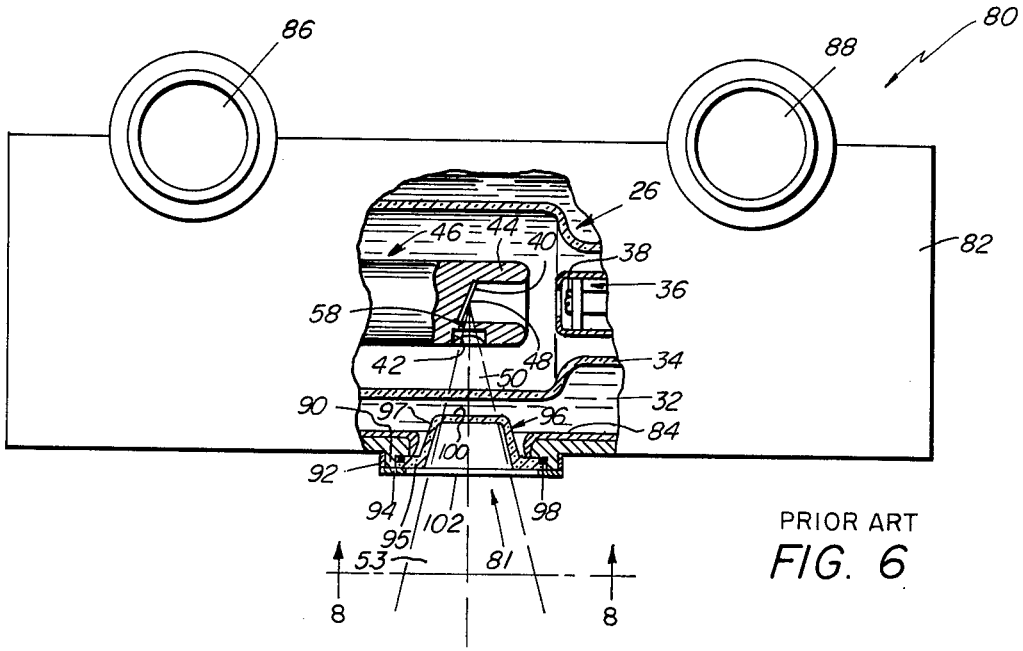
PRIOR ART FIG. 6
FIG. 6 is a plan view of an X-ray generator of the conventional type.

Referring to the drawings wherein like characters of reference designate like parts, there is shown in FIGS. 1–3 an X-ray generator 20 comprising a hollow cylindrical housing 22 having closed ends and made of rigid material, such as aluminum, for example. The housing 22 is shielded by suitable means, as by having an interior rayproofing lining 24 made of X-ray opaque material, such as lead, for example. Insulatingly mounted by conventional means in housing 22 is a longitudinally disposed X-ray tube 26 which may be of the stationary anode type, such as disclosed in U.S. Pat. No. 2,886,724 granted to G. W. Steen and assigned to the assignee of this invention, for example. Housing 22 preferably is provided with a conventional pair of spaced electrical receptacles, 28 and 30, respectively, which communicate electrically with the anode and cathode electrodes, respectively, of X-ray tube 26. The X-ray tube 26 may be surrounded by a dielectric coolant fluid 32, such as oil, for example, which is caused to flow through the housing 22 by well-known means (not shown).

X-ray tube 26 includes an evacuated tubular envelope 34 made of X-ray transmissive material, such as lead-free glass, for example. Extending axially into envelope 34 from one end thereof is an electron emitting cathode 36 which may comprise a transversely disposed filament 38 supported within a focusing cup 39. The filament 38 is disposed in spaced aligned relationship with a sloped target surface 40 which is made of X-ray emissive material, such as tungsten, for example. The target surface 40 slopes in the direction of a radially aligned aperture 42 in an encircling hood 44 which is axially spaced from the cathode 36. The hood 44 constitutes an inner end portion of an anode cylinder 46 which extends axially out of the other end of envelope 34. The anode 46 and the cathode 36 are electrically connected by conventional means to respective receptacles 28 and 30 for having suitable electrical potentials applied thereto during operation of the X-ray tube 26.

In operation, the filament 38 is electrically heated to emit electrons which are focused into a beam by the cup 39 and are electrostatically accelerated toward the target surface 40. As a result, the high energy electrons in the beam impinge on the sloped target surface 40 in a suitably configured focal spot area 48, such as the small square area shown in FIG. 2, for example. Alternatively, as shown in FIG. 4*a*, the focal spot area 48 may comprise a narrow rectangle extending longitudinally along the slope of target surface 40. Also, as shown in FIG. 4*b*, the focal spot area 48 may comprise a narrow rectangle extending transversely of the slope of target surface 40. In each instance, however, there is generated in the material of target surface 40 X-rays which radiate outwardly from the focal spot area 48 in all directions. The X-rays radiating in the direction of radially aligned aperture 42 pass through it in a divergent beam 50, which also passes radially through aligned portions of envelope 34 and dielectric fluid 32.

In accordance with this invention, the housing 22 has disposed in a wall portion thereof radially aligned with the focal spot area 48 an arcuate port 52 which is substantially concentric with the center of focal spot area 48. The port 52 may comprise a grooved cavity 54 cut transversely in the cylindrical wall of housing 22 to provide at the bottom of the cavity an arcuate wall 56 which is substantially of uniform thickness and symmetrically disposed with respect to the focal spot area 48. Radially aligned with the cavity 54 is a similarly configured opening 57 in the rayproof lining 24 of housing 22. Accordingly, the X-rays in beam 50 passing through the aperture 42 also pass through substantially uniform thicknesses of the envelope 34, the dielectric fluid 32, and the wall 56. Consequently, the opening 57 in lining 24 and the grooved cavity 54 of port 52 function as collimator means for permitting a fan-shaped beam 51 having a substantially uniform cross-sectional intensity to egress from the X-ray generator 20. Also, the symmetry of arcuate wall 56 with respect to the highly positive anode cylinder 46 maintains the electrostatic fields therebetween substantially uniform, in contrast to the field distortions caused by a reentrant window of a conventional recessed port, for example.

The thickness of the arcuate wall 56 may be determined by the transmission of X-rays above a preferred frequency. Thus, the wall 56 may be provided with sufficient thickness to permit "hard" X-rays to pass through it, while absorbing any "soft" X-rays in the beam 50. Accordingly, the wall 56 functions as a filter to permit the passage of X-rays having respective energies above a predetermined level. When additional filtering is required, there may be disposed in the aperture 42 of hood 44 a filter 58 made of suitable material, such as beryllium, for example. As a result, X-rays having respective frequencies below a predetermined value may be filtered out of the beam 50 within the X-ray tube 26.

As shown in FIG. 5, a computerized tomographic system 60 may include the described X-ray generator 20 having mounted over its arcuate port 52 a conventional collimator 62. The collimator is adjusted to control the cross-sectional size of the fan-shaped beam 51 egressing from the X-ray generator 20. As a result, a collimated fan-shaped beam 51*a* emerging from the collimator 62 passes through a planar portion 64 of a patient and impinges on an arcuate array 66 of detectors 68. Consequently, the detectors 68 produce respective output signals which pass through connecting conductors 70 to a suitable computer 72 for storage and processing in a well-known manner. Accordingly, the X-ray generator 20 is energized and rotated in one angular direction around the portion 64, while the detector array 66 is rotated correspondingly in the opposite angular direction. Thus, the detectors 68 feed respective sequential series of signals to the computer 72 which, after processing them, produces a picture of the planar portion 64 on an electrically connected display monitor 74. Due to the uniformity of the fan-shaped beam 51 produced by the X-ray generator 20 of this invention, the described tomographic system may be enabled to detect absorption differences on the order of about one-half of one percent in the planar portion 64 of the patient.

Figure 7:
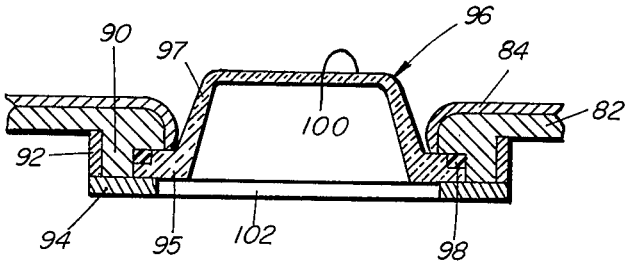
PRIOR ART FIG. 7
FIG. 7 is an enlarged fragmentary sectional view of the housing port shown in FIG. 6.
Figure 8:
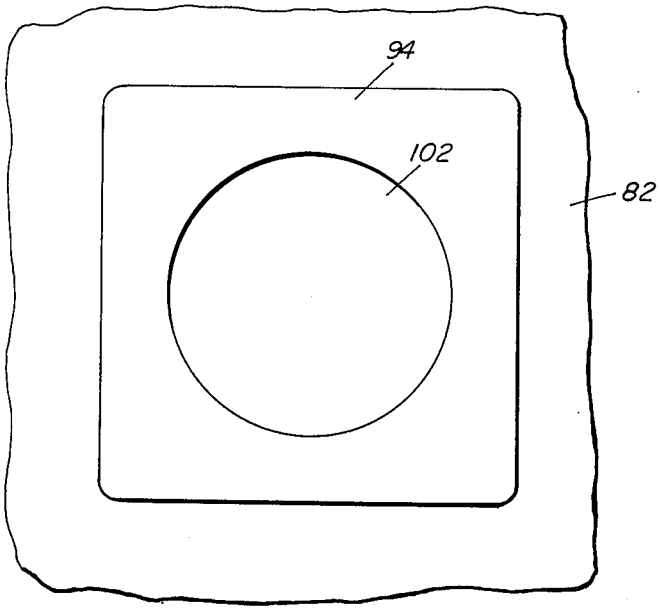
PRIOR ART FIG. 8
FIG. 8 is a fragmentary elevational view taken along the line 8—8 shown in FIG. 6 and looking in the direction of the arrows.

By way of comparison, there is shown in FIGS. 6–8 an X-ray generator 80 similar in structure to the X-ray generator 20 but having a housing 82 provided with a conventional recessed port 81. Thus, the housing 82 may comprise a hollow cylinder having longitudinally disposed therein the described X-ray tube 26, and having an interior lining 84 made of X-ray opaque material. Also, the housing 82 may have a dielectric coolant fluid 32 flowing therethrough, and may be provided with spaced electrical receptacles 86 and 88, respectively. The receptacles 86 and 88 are connected to the anode 46 and cathode 36, respectively, of X-ray tube 26 for directing a beam of electrons onto the focal spot area 48 of sloped target surface 40. As a result, the divergent X-ray beam 50 emanating from the focal spot area 48 passes through the aperture 42 in anode hood 44 and then through radially aligned portions of the tube envelope 34 and the dielectric coolant fluid 32.

An aligned cylindrical wall portion of housing 80 is provided with an outwardly extending flange 90, which may have a rectangular outer periphery and a circular inner periphery. The outer periphery of flange 90 is encircled by a collar 92 of X-ray opaque material, such as lead, for example, which is retained in place by a rectangular plate 94 secured to the flange 90. The plate 94 bears against an annular flange 95 of a reentrant window 96 to compress an "o" ring 98 against a shoulder on the inner periphery of flange 90 which encircles a circular opening in the wall of housing 82. The reentrant window 96 has an inwardly tapering annular wall 97 which extends through a suitably configured opening in lining 84 and supports a substantially flat circular surface 100 of window 96 adjacent the envelope 34. Because of the resulting proximity of the flat surface 100 adjacent the highly positive anode 46, the window 96 preferably is made of X-ray transmissive material which also is dielectric, such as polycarbonate resin material, for example. The retaining plate 94 is made of an X-ray opaque material, such as lead, for example, which has a central aperture 102 substantially aligned with the flat surface 100 of window 96.

Thus, the divergent beam 50 emanating from the focal spot area 48 passes through the flat surface 100 of window 96 and egresses from the X-ray generator 80 through the aperture 102 in plate 94 as a substantially conical beam 53. Consequently, X-rays adjacent the outer periphery of beam 50 pass angularly through greater thicknesses of the dielectric fluid 32 and the flat surface 100, respectively, as compared with X-rays adjacent the axial centerline of beam 50. As a result, the extreme angularly diverging X-rays in beam 50 undergo a greater absorption than the centrally directed X-rays thereby rendering an incident cross-section of the beam 53 non-uniform. Accordingly, the X-ray beam 53 emerging from X-ray generator 80 is not as suitable as the X-ray beam 51 emerging from X-ray generator 20 for use in the computerized tomography system shown in FIG. 5, where absorption differences in a patient on the order of one-half of one percent are important. Note in FIGS. 1 and 2 that the arcuate configuration of the window 56 in port 52 ensures that the extreme angularly diverging X-rays in beam 50, as compared to the centrally directed X-rays thereof, pass through substantially equivalent thicknesses of the dielectric fluid 32 and the window 56, respectively.

In FIGS. 9 and 10, there is shown an alternative embodiment comprising an X-ray generator 104 having a housing 106 similar in structure to the housing 82 but having a port 108 in accordance with this invention. Thus, housing 106 may comprise a hollow cylinder having closed ends and made of rigid material, such as aluminum, for example. The housing 106 also may have an interior lining 109 made of X-ray opaque material, such as lead, for example, and may be provided with spaced electrical receptacles 110 and 112, respectively. Insulatingly mounted by conventional means in housing 106 is an X-ray tube 114, which may be of the rotating anode type, for example; and a dielectric coolant fluid 116 may flow through the housing 106.

X-ray tube 114 includes an evacuated envelope 118, which preferably has a spherically curved central portion surrounding a transversely disposed anode disc 120. The disc 120 is mounted on a stem 122 for rotation about its axis in a well-known manner, and carries adjacent its outer periphery a sloped annular target surface 124 made of X-ray emitting material, such as tungsten, for example. An electron emitting cathode 126 is disposed to direct an electron beam onto a focal spot area 128 of the target surface 124 which is radially aligned with the port 108 in housing 106. The focal spot area 128 may, for example, have a narrow rectangular configuration, the longitudinal dimension of which is shown in FIG. 11a as being disposed along the slope of the target surface 124 and is shown in FIG. 11b as being orthogonally disposed with respect to the slope of the target surface 124. As a result of electrons impinging on the focal spot area 128, a divergent X-ray beam 130 emanates therefrom and passes through aligned portions of the envelope 118 and the dielectric fluid 116 to egress from the generator 104 through port 108.

The port 108 may include a wall portion of housing 106 having an outwardly extending flange 132 which encircles an opening extending through the wall of housing 106 and the X-ray lining 109. The flange 132 may have a rectangular outer periphery, which is encircled by an X-ray opaque collar 131, and a circular inner periphery, which is provided with a shoulder 134. Demountably attached, as by screws (not shown) for example, to the outer surface of flange 132 is a retaining plate 136 which urges an annular flange 137 of an X-ray transmissive window 138 against an "o" ring 139 seated on the shoulder 134. The window 138 comprises an arcuate wall 140 which is symmetrically disposed with respect to the center of focal spot area 128 and is of sufficient thickness to permit X-rays of the desired wavelengths in beam 130 to egress from the generator 104. Thus, as shown in FIGS. 9 and 10, the wall 140 may have a spherical curvature which is concentric with the center of focal spot area 128 and may be made of a material which is electrically conductive, such as aluminum, for example, or a dielectric material, such as polycarbonate resin, for example. Accordingly, X-rays in the divergent beam 130 pass through substantially equal thicknesses of the dielectric fluid 116 and the wall 142 of window 138. As a result, the conical X-ray beam 130 emerging from the window 138 has a substantially uniform cross-sectional distribution of intensity or energy, due to the extreme angular X-rays in the beam travelling path lengths substantially equivalent to the centrally directed X-rays.

Alternatively, as shown in FIGS. 12 and 13, the window 138 may comprise a solid hemispherical plate 142 having an arcuately bottomed groove 144 transversely disposed in the inner surface thereof. The retaining plate 136 may be demounted and the hemispherical plate 140 rotated within the flange 132 to orient the groove 144, as desired, with respect to the axis of X-ray tube 114. Thus, the groove 144 may be positioned substantially parallel with the axis of tube 114, as shown in FIG. 12, or may be positioned substantially perpendicular with respect to the axis of tube 114, as shown in FIG. 13, for examples. The resulting arcuate wall provided by groove 144 is symmetrically disposed with respect to the focal spot area 128 and of sufficient thickness to permit X-rays of desired wavelengths in beam 130 to egress from the generator 104. Accordingly, the groove 144 in hemispherical plate 142 transmits a fan-shaped beam having a substantially uniform cross-section similar to the fan-shaped beam produced by the generator 20 shown in FIG. 1. Consequently, the fan-shaped beam produced by the grooved hemispherical window 138 of generator 104 also is suitable for use in a computerized tomographic system, such as shown in FIG. 5, for example.

Thus, there has been disclosed herein an X-ray beam generator comprising an X-ray shielded housing having an X-ray transmissive window which is disposed symmetrically in radial alignment with a focal spot area on a sloped target surface of an X-ray tube in the housing.

The X-ray tube may be of the stationary anode type or of the rotating anode type, for examples. Also, the window may comprise an integral portion of the housing wall or may comprise a plate suitably disposed in an opening in the housing wall, for examples. Accordingly, the stationary anode, X-ray tube shown in FIG. 1 may be used with the type of housing shown in FIG. 9; and the rotating anode, X-ray tube shown in FIG. 9 may be used with the type of housing shown in FIG. 1.

From the foregoing, it will be apparent that all of the objectives of this invention have been achieved by the structures shown and described. It also will be apparent, however, that various changes may be made by those skilled in the art without departing from the spirit of the invention as expressed in the appended claims. It is to be understood, therefore, that all matter shown and described is to be interpreted as illustrative rather than in a limiting sense.

What is claimed is:

1. An X-ray beam generator comprising:

an X-ray tube including a tubular envelope having therein a focal spot area on a target surface disposed to direct a divergent X-ray beam out of the envelope; and an X-ray shielded housing disposed to enclose the X-ray tube and including X-ray transmissive means disposed substantially concentric with respect to the center of the focal spot area for permitting egress of at least a portion of the beam having a desired configuration.

2. An X-ray beam generator as set forth in claim 1 wherein the X-ray transmissive means includes a portion of the housing having therein a cavity aligned with an X-ray transparent wall concentrically spaced from the focal spot area on the target surface.

3. An X-ray beam generator as set forth in claim 2 wherein the portion of the housing has therein a grooved cavity aligned with an arcuate wall concentrically disposed with respect to the center of the focal spot area.

4. An X-ray beam generator as set forth in claim 3 wherein the arcuate wall is transversely disposed with respect to the envelope of the tube.

5. An X-ray beam generator as set forth in claim 3 wherein the arcuate wall is axially disposed with respect to the envelope of the tube.

6. An X-ray beam generator as set forth in claim 2 wherein the X-ray transparent wall is spherically curved with respect to the center of the focal spot area.

* * * * *